US011136512B2

(12) United States Patent
Koseoglu

(10) Patent No.: US 11,136,512 B2
(45) Date of Patent: Oct. 5, 2021

(54) TWO-STAGE HYDROCRACKING UNIT WITH INTERMEDIATE HPNA HYDROGENATION STEP

(71) Applicant: SAUDI ARABIAN OIL COMPANY, Dhahran (SA)

(72) Inventor: Omer Refa Koseoglu, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 11 days.

(21) Appl. No.: 16/704,871

(22) Filed: Dec. 5, 2019

(65) Prior Publication Data

US 2021/0171843 A1 Jun. 10, 2021

(51) Int. Cl.

| | |
|---|---|
| ***C10G 65/12*** | (2006.01) |
| ***C10G 45/52*** | (2006.01) |
| ***C10G 47/02*** | (2006.01) |
| ***C10G 45/10*** | (2006.01) |

(52) U.S. Cl.

CPC ..... *C10G 65/12* (2013.01); *C10G 45/10* (2013.01); *C10G 45/52* (2013.01); *C10G 47/02* (2013.01); *C10G 2300/1074* (2013.01); *C10G 2300/301* (2013.01); *C10G 2300/4081* (2013.01); *C10G 2300/70* (2013.01); *C10G 2400/04* (2013.01); *C10G 2400/28* (2013.01)

(58) Field of Classification Search

CPC ..... C10G 45/44; C10G 45/52; C10G 65/12

See application file for complete search history.

(56) References Cited

U.S. PATENT DOCUMENTS

| | | | | |
|---|---|---|---|---|
| 3,240,694 A | | 3/1966 | Mason et al. | |
| 3,655,551 A | | 4/1972 | Hass et al. | |
| 4,404,088 A | * | 9/1983 | Bachtel | C10G 65/10 208/111.01 |
| 4,618,412 A | * | 10/1986 | Hudson | C10G 65/12 208/112 |
| 4,713,167 A | | 12/1987 | Reno et al. | |
| 4,950,384 A | | 8/1990 | Groeneveld et al. | |
| 5,007,998 A | * | 4/1991 | Gruia | C10G 65/12 208/100 |
| 5,026,472 A | | 6/1991 | Hoehn et al. | |

(Continued)

FOREIGN PATENT DOCUMENTS

| | | |
|---|---|---|
| CN | 1955258 A | 5/2007 |
| CN | 103059972 A | 4/2013 |

(Continued)

OTHER PUBLICATIONS

International Search Report and Written Opinion issued in corresponding International Application No. PCT/US2020/014969, dated Aug. 7, 2020 (11 pages).

*Primary Examiner* — Renee Robinson

(74) *Attorney, Agent, or Firm* — Osha Bergman Watanabe & Burton LLP

(57) ABSTRACT

A method and a system for hydrocracking an oil feedstock to produce a light oil stream without build-up of heavy polynuclear aromatic (HPNA) hydrocarbons in the recycle stream. The method may include hydrocracking an oil feedstock, separating the produced effluent into a first, second, and third product stream, and hydrogenating the third product stream in a third reactor over a noble metal hydrogenation catalyst at an operational pressure equal to or less than the second reactor.

15 Claims, 2 Drawing Sheets

(56) References Cited

U.S. PATENT DOCUMENTS

| | | | | |
|---|---|---|---|---|
| 5,139,644 | A | 8/1992 | Gruia | |
| 5,364,514 | A | 11/1994 | Sanborn et al. | |
| 5,885,440 | A | 3/1999 | Hoehn et al. | |
| 5,904,835 | A | 5/1999 | Thakkar | |
| 6,113,775 | A | 9/2000 | Christolini et al. | |
| 6,217,746 | B1 | 4/2001 | Thakkar et al. | |
| 6,312,586 | B1 | 11/2001 | Kalnes et al. | |
| 6,858,128 | B1 | 2/2005 | Hoehn et al. | |
| 8,343,334 | B2 | 1/2013 | Koseoglu | |
| 9,663,732 | B2 | 5/2017 | Ganyu | |
| 9,783,748 | B2 | 10/2017 | Harvey et al. | |
| 10,208,261 | B2 | 2/2019 | Arora et al. | |
| 10,301,560 | B2 | 5/2019 | Wang et al. | |
| 2011/0079541 | A1 | 4/2011 | Koseoglu | |
| 2011/0220546 | A1 | 9/2011 | Koseoglu et al. | |
| 2013/0220885 | A1 | 8/2013 | Low et al. | |
| 2014/0360918 | A1 | 12/2014 | Koseoglu | |
| 2016/0115403 | A1 | 4/2016 | Macris | |
| 2017/0362516 | A1* | 12/2017 | Wang | C10G 65/12 |
| 2018/0362864 | A1* | 12/2018 | Verstraete | C10G 67/02 |
| 2020/0216765 | A1* | 7/2020 | Guillon | C10G 45/48 |

FOREIGN PATENT DOCUMENTS

| | | | |
|---|---|---|---|
| CN | 104357083 | A | 2/2015 |
| CN | 103773464 | A | 7/2015 |
| CN | 107286989 | A | 10/2017 |
| FR | 3076296 | A1 | 7/2019 |

* cited by examiner

TWO-STAGE HYDROCRACKING UNIT WITH INTERMEDIATE HPNA HYDROGENATION STEP

BACKGROUND

Hydrocracking processes are used commercially in a large number of petroleum refineries. They are used to process a variety of feeds boiling in the range of 370° C. to 520° C. in conventional hydrocracking units and boiling at 520° C. and above in the residue hydrocracking units. In general, hydrocracking processes split the molecules of the feed into smaller, i.e., lighter, molecules having higher average volatility and economic value. Additionally, hydrocracking processes typically improve the quality of the hydrocarbon feedstock by increasing the hydrogen to carbon ratio and by removing organosulfur and organonitrogen compounds. The significant economic benefit derived from hydrocracking processes has resulted in substantial development of process improvements and more active catalysts.

Hydrotreating and hydrocracking units generally include two principal zones, reaction and separation. Key parameters such as feedstock quality, product specification/processing objectives and catalysts typically determine the configuration of the reaction zone.

Hydrotreating is a process in which a hydrocarbon-containing feedstock is contacted with hydrogen gas in the presence of one or more hydrotreating catalysts that primarily effect the removal of one or more heteroatoms (such as sulfur and nitrogen) and/or metals from the hydrocarbon-containing feedstock. During hydrotreating processes, unsaturated hydrocarbons such as olefins, alkynes and aromatics may become saturated through reaction with hydrogen.

Mild hydrocracking or single stage once-through hydrocracking occurs at operating conditions that are more severe than hydrotreating processes, and less severe than conventional full pressure hydrocracking processes. This hydrocracking process is more cost effective, but typically results in lower product yields and quality. The mild hydrocracking process produces less mid-distillate products of a relatively lower quality as compared to conventional hydrocracking. Single or multiple catalysts systems can be used depending upon the feedstock processed and product specifications. Single stage hydrocracking is the simplest configuration, and are designed to maximize mid-distillate yield over a single or dual catalyst systems. Dual catalyst systems are used in a stacked-bed configuration or in two different reactors.

In a series-flow configuration, the entire hydrotreated/hydrocracked product stream from the first reactor, including light gases including $C_1$-$C_4$, $H_2S$, $NH_3$, and all remaining hydrocarbons, are sent to the second reactor. In two-stage configurations, the feedstock is refined by passing it over a hydrotreating catalyst bed in the first reactor. The effluents are passed to a separating unit comprising a separator for separating the gas and liquid phases of the effluent and a fractionator column to further separate the produced liquid stream. The separating unit may be utilized for the separation of the $H_2S$, $NH_3$, light gases ($C_1$-$C_4$), naphtha and diesel products boiling in the temperature range of 36-370° C. from the effluents of the first reactor. The hydrocarbons boiling above 370° C. are then passed to the second reactor.

The formation of heavy polynuclear aromatics ("HPNA") is an undesirable side reaction that occurs in recycle hydrocrackers. The HPNA molecules form by dehydrogenation of larger hydro-aromatic molecules or cyclization of side chains onto existing HPNAs followed by dehydrogenation, which is favored as the reaction temperature increases. HPNA formation depends on many known factors including the type of feedstock, catalyst selection, process configuration, and operating conditions. Since HPNAs accumulate in the recycle system and then cause equipment fouling, HPNA formation must be controlled in the hydrocracking process.

Referring to FIG. 1, a conventional two-stage hydrocracking unit with recycling of unconverted fractions is illustrated in greater detail. A feedstock 11 is hydrotreated/hydrocracked in a first reactor 10 over a hydrotreating catalyst bed, usually comprising amorphous based catalyst(s), such as amorphous alumina, silica alumina, or titania substrates containing Ni/Mo, Ni/W or Co/Mo metals as the active phase. The first reactor effluents 12 are then fractionated, and the light fractions 21 containing $H_2S$, $NH_3$, $C_1$-$C_4$ gases, naphtha and diesel fractions boiling up to a nominal boiling point of 370° C. are separated. The hydrocarbon fraction 22 boiling above 370° C. are then sent to the second reactor 30 containing amorphous and/or zeolite based catalyst(s) having Ni/Mo or Ni/W metals as the active phase. The effluents 31 from the second reactor 30 are sent to the separation unit 20, in a combined stream 13 with effluent 12 from the first reactor 10, for separation of cracked components. The HPNA molecules form during the process and accumulate in the recycle stream. Therefore, in conventional two-stage hydrocracking processes, HPNAs must be rejected via a bleed stream 23 or processed separately to eliminate equipment fouling, or an effective catalyst must be used to eliminate the formation of HPNAs or to hydrogenate and hydrocrack these heavy molecules into smaller ones.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method of hydrocracking an oil feedstock to produce a light oil stream without build-up of heavy polynuclear aromatic (HPNA) hydrocarbons in the recycle stream. The method may include hydrocracking the oil feedstock with a first stage hydrocracking catalyst possessing hydrotreating and hydrocracking functionality in a first reactor to produce an effluent stream, and then fractionating the effluent stream into first, second and third product streams, where the first product stream comprises $H_2S$, $NH_3$, $C_1$-$C_4$, naphtha, and diesel boiling in the range of 36-370° C., the second product stream comprises hydrocarbon components having an initial nominal boiling point of 370° C. and a final boiling point ranging from 420-750° C., and the third product stream comprises HPNA hydrocarbons and other hydrocarbons boiling above 420° C. to 750° C., depending upon the final boiling point of the second product stream cracking the second product stream in a second reactor. It may then include hydrogenating the third product stream in a third reactor over a noble metal hydrogenation catalyst at an operational pressure equal to or less than the second reactor.

In a further aspect, embodiments disclosed herein relate to a system for hydrocracking an oil feedstock to produce a light oil stream without build-up of heavy polynuclear aromatic (HPNA) hydrocarbons in the recycle stream. The system may include a hydrotreating reactor comprising a hydrotreating and/or hydrocracking catalyst; a separation unit; a second reactor comprising a hydrocracking catalyst; and a third reactor comprising a noble metal hydrogenating catalyst. The hydrotreating reactor may feed to a separation unit, and the separation unit may feed a first product stream out of the apparatus, a second stream to the second reactor and a third stream to the third reactor. The system may further include a third reactor that may be configured to operate at a lower pressure than the second reactor.

Other aspects and advantages of the claimed subject matter will be apparent from the following description and the appended claims.

DETAILED DESCRIPTION

One or more embodiments of the present disclosure generally relate to an apparatus and a method for processing hydrocarbon by-products that include heavy polynuclear aromatics (HPNAs) for the purpose of increasing the production of lighter hydrocarbon fuels, such as gasoline and diesel, in conjunction with the operation of a hydrocracking process.

As described above, hydrocracking processes generally break the molecules of a feedstock into smaller, i.e. lighter, molecules that may have a having higher average volatility and economic value than the feedstock. Hydrocracking processes in accordance with the present disclosure generally comprise combining a hydrocarbon feed with hydrogen gas, and subjecting the mixture to elevated temperatures in the presence of a hydrocracking/hydrotreating catalyst. The conditions of the present hydrocracking processes are not particularly limited, and may be any suitable conditions known to one of ordinary skill in the art.

An increase in the production of lighter hydrocarbon fuels may be achieved by utilizing a method of hydrocracking an oil feedstock to produce a light oil stream without build-up of HPNA hydrocarbons in the recycle stream. The method, according to one or more embodiments described herein, comprises hydrocracking an oil feedstock with a hydrotreating/hydrocracking catalyst in a first reactor to produce an effluent stream. In particular, the effluent stream from the first reactor is fractioned into a first, second and third product streams. The first product stream may comprise $H_2S$, $NH_3$, $C_1$-$C_4$, naphtha, and diesel boiling in the range of about 36° C. to about 370° C., and the second product stream may comprise hydrocarbon components with an initial nominal boiling point of 370° C. and a final boiling point ranging from about 420° C. to about 750° C. The third product stream may boil above about 420° C. to about 750° C., depending upon the final boiling point of the second product stream, and may comprise HPNA hydrocarbons.

Following fractionation, the second product stream and third product stream are sent to additional reactors, e.g., a second reactor and third reactor, respectively. The second reactor (being fed the second product stream having the middle boiling point range) may be a hydrocracking reactor, and the third reactor (being fed the third product stream having the highest boiling point range and containing HPNAs) may be a hydrogenation reactor. The second reactor and third reactor may operate at different pressures and contain different catalysts. In particular, the operating pressure of third reactor is less than that of the second reactor.

Figure 2:
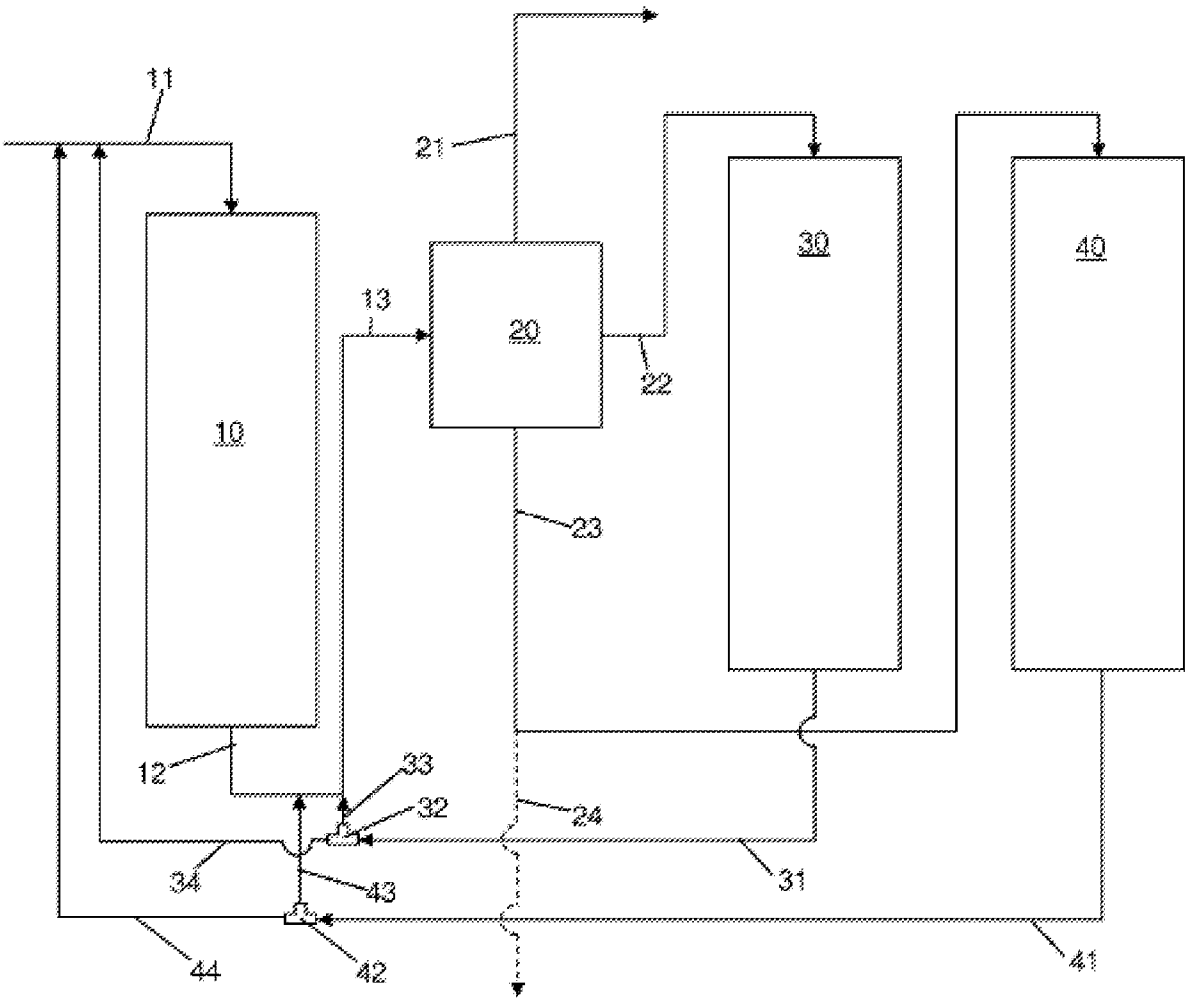
FIG. 2 is a schematic diagram of an embodiment of the apparatus and process of the present system.

Referring now to FIG. 2, FIG. 2 illustrates an embodiment of the process and system of the present disclosure. In the two-stage recycle hydrocracking process, a feedstock influent stream 11 is introduced into a hydrotreating reactor 10 and is hydrocracked with a first stage hydrocracking catalyst containing hydrotreating and hydrocracking functions to produce an effluent stream 12. In general, the feedstock influent stream 11 may comprise at least one of a vacuum gas oil, deasphalted or demetalized oil from solvent deasphalting process, light and heavy coker gas oils from a coker process, cycle oils from fluid catalytic cracking ("FCC") process derived from crude oils, synthetic crude oils, heavy oils and/or bitumen, shale oil and coal oils. In a particular embodiment, the feedstock stream 11 and hydrogen are fed to the first reactor 10 for hydrotreating, which may optionally include hydrodesulfurization, hydrodenitrogenation, and hydrodemetalization, along with cracking high molecular weight, high boiling temperature molecules into lower molecular weight, lower boiling point temperature hydrocarbons in the range about 5% to about 60% by volume.

The hydrotreating/hydrocracking catalyst of the hydrotreating reactor 10 may comprise an amorphous based catalyst(s), such as amorphous alumina, silica alumina, or titania substrates containing Ni/Mo, Ni/W or Co/Mo metals as the active phase, or amorphous catalyst, zeolite catalyst, or a composite mixture thereof, promoted with Ni, W, Mo and Co metals, to obtain 10% to 80% by volume conversion of hydrocarbons boiling above 370° C. at hydrogen partial pressure in the range of about 100-200 kg/cm$^2$, in certain embodiments about 100-170 kg/cm$^2$, and in further embodiments about 100-150 kg/cm$^2$; and feedstock oil in the range 300-2000 m$^3$ over 1000 m$^3$ of the hydrotreating catalyst per hour. The hydrocarbons boiling above 370° C. are converted to one or more light gases including methane, ethane, propane, n-butane, isobutene, hydrogen sulfide, ammonia, naphtha fractions boiling in the range of 36° C. to 180° C. and/or diesel fractions boiling in the range of 180° C. to 375° C.

After the feedstock influent stream is hydrocracked and hydrotreated in the hydrotreating reactor, all of the reactor effluents, i.e., effluent stream 12, are sent to the separation unit 20.

In particular, the effluent stream 12 is fractioned into a first product stream 21, a second product stream 22 and a third product stream 23. The first product stream 21 comprises $C_1$-$C_4$, and naphtha and diesel products boiling in the range of about 36° C. to about 370° C. For feedstocks 11 containing organosulfur and/or organonitrogen compounds that are hydrodesulfurized and/or hydrodenitrogenized (which may occur in reactor 10), the first product stream 21 may also contain $H_2S$ and/or $NH_3$. The second product stream 22 includes products having an initial boiling point of 370° C. and final boiling point lower than the feedstock end point, preferably in the range of 420-750° C. The third product stream 23 includes products having a fraction boiling above the end point of the second product stream, that is, above 420° C. to above 750° C., depending upon the final boiling point of the fraction in the second product stream 22.

First product stream 21 containing $H_2S$, $NH_3$, light gases including $C_1$-$C_4$, naphtha and diesel products boiling in the nominal temperature range of about 36° C. to about 370° C. may be removed from the system, such as for further downstream processing and separations.

The second product stream 22 from separation unit 20 (including fractions with an initial nominal boiling point temperature of about 370° C. and final boiling point temperatures ranging from about 420° C. to about 750° C.) is sent to the second reactor 30 for cracking of unconverted molecules from the first reactor 10. In particular, the second product stream 22 is cracked in a second reactor 30 to produce product stream 31. Stream 31 from the second reactor 30 includes light gases such as $C_1$-$C_4$; naphtha boiling in the range $C_5$, i.e., about 36° C., to about 180° C., and up to about 200° C. to about 220° C. under certain conditions; and diesel boiling in the range of about 180° C. to about 370° C., as well any remaining uncracked hydrocarbon fractions from reactor 30 boiling above about 370° C. Thus, product stream 31 from second reactor 30 (hydrocracker) are recycled to the hydrotreating reactor 10 via line 34 through a three-way valve 32 and/or to the separation unit 20 via a line 33. Light gases such as $C_1$-$C_4$; naphtha boiling in the range $C_5$, i.e., about 36° C., to about 180° C., and up to about 200° C. to about 220° C. under certain conditions; and diesel boiling in the range of about 180° C. to about 370° C. in product stream 31 may thus be removed from the system (at separation unit 20) in product stream 21, while any remaining uncracked hydrocarbon fractions from reactor 30 boiling above about 370° C. that are present in product stream 31 may be subjected to further cracking (either in first reactor 10 or second reactor 30).

The hydrocracking conducted in the second reactor 30 of one or more embodiments may utilize any suitable hydrocracking catalyst or configuration known to one of ordinary skill in the art. Generally, such catalysts include a hydrogenatively-active metal component and an acidic support component. In certain embodiments, the hydrocracking catalyst includes any one of amorphous alumina catalysts, amorphous silica-alumina catalysts, titania catalysts, natural or synthetic zeolite based catalyst, a post modified zeolite, or a combination thereof. The hydrocracking catalyst can possess an active phase material including, in certain embodiments, any one of or combination including Ni, W, Mo, Co or a combination thereof. In other embodiments, the catalyst may include one or more noble metals such as Pt or Pd. In certain embodiments in which an objective is hydrodenitrogenation, acidic alumina or silica alumina based catalysts loaded with Ni—Mo, or Ni—W active metals, or combinations thereof, are used. In embodiments in which the objective is to remove all nitrogen and to increase the conversion of hydrocarbons, silica alumina, zeolite or combination thereof are used as catalysts, with active metals including Ni—Mo, Ni—W or combinations thereof.

As mentioned above, the third product stream 23 boils above 420° C. to above 750° C., depending upon the final boiling point of the second product stream, and comprises HPNA hydrocarbons. The product stream 23 containing HPNA molecules is sent to the third reactor 40 for hydrogenation. Third reactor 40 is operated at a milder pressure than the second reactor 30. In one or more embodiments, third reactor 40 operates at a pressure ranging from 50-90 kg/cm$^2$, which advantageously reduces the volume requirements of the third reactor. The third reactor 40 contains large pore catalyst that performs hydrogenation function. The high boiling point HPNA molecules are hydrogenated in third reactor 40, and the effluents 41 from the third reactor 40 are recycled to the hydrotreating reactor 10 via line 44 through a three-way valve 42 and/or to the separation unit via a line 43. In one or more embodiments, in separation unit 20, the recycled effluent 41 may be sent to second reactor 30 or third reactor 40 for further processing. Thus, stream 13 being fed into separation unit 20 may include streams 12, 31 and 41. In one or more alternative embodiments, residual unreacted HPNA from the effluent 41 may be directed to the separation unit 20 via line 43 where it may be separated and removed from the two stage hydrocracking system via bleed stream 24. In particular, stream 24, comprising hydrocarbons boiling above 520° C. and residual unreacted HPNA, can be removed from process in the range less than 10% by volume, less than 5% by volume, less than 3% by volume, less than 2% by volume, less than 1% by volume, less than 0.5% by volume, or less than 0.1% by volume.

In one or more embodiments, third reactor 40 that may contain large pore catalysts, such as USY zeolite based catalyst, amorphous silica alumina catalyst and/or amorphous alumina catalyst and/or titania catalyst with hydrogenation and/or hydrocracking active species for further hydrogenation and/or hydrocracking. As used herein "large" pore catalysts refers to those having average pore diameters of greater than about 100 angstroms, and in certain embodiments having average pore diameters of greater than about 500 angstroms.

The hydrogenation catalyst of the third reactor 40 may be comprised of an ultra-stable USY type zeolite, with a framework in which part of the aluminum has been substituted with Zr and Ti, and to which a hydrogenating metal has been added. The hydrogenating metal may preferably be added in an amount of from 0.01-1.0 wt % of the total weight of catalyst. Hydrogenating metal, as used herein, includes the noble metals, i.e., Ru, Rh, Pd, Ag, Os, Jr, Pt, and Au, with Ru, Pt and Pd being preferred. In one or more embodiments, the third reactor contains large pore zeolite based catalyst or amorphous based catalyst, or a combination thereof. In one or more embodiments, the third reactor may contain an unsupported metal catalyst, in which the unsupported metal catalyst includes a metal selected from Ni, Mo, W, Co, Zn, Zr, or combinations thereof.

The different functionality of the second stage reactor of the present disclosure reduces the capital cost of the hydrocracking unit. Large HPNA molecules, hydrogenation of which is favored over noble metal catalysts at milder or lower pressures, can diffuse into the large pores of the catalyst in the third reactor 40 and hydrogenate into the naphthenic version of the HPNA compounds. This processing step prevents the build-up of heavy HPNA molecules in the recycle stream without eliminating the use of small pore zeolite based catalysts in the second reactor 30. Thus, this configuration does not eliminate the use of zeolite based cracking catalysts completely. Rather, the second reactor 30 containing zeolite based catalyst will enhance the cracking of hydrocarbons, while large molecules are hydrogenated over noble metal catalysts in the third reactor 40.

Advantageously, the third reactor 40 is operated at milder or lower pressures than the second reactor 30 in order to hydrogenate HPNA molecules. In one or more embodiments, the operating pressure for the first and second reactors may range from 100 to 200 Kg/cm$^2$; and in other embodiments, from 110 to 130 Kg/cm$^2$. In general, the operating pressure of the third reactor is about 10% to about 100% less than the operating pressure of the second reactor, in certain embodiments about 30% to about 70% less than the operating pressure of the second reactor, and in further embodiments about 30% to about 50% less than the operating pressure of the second reactor. The noble metal catalyst of the third reactor 40 requires less pressure and as a result, the third reactor may be smaller than the second reactor and specifically designed to operate at lower pressures. In one or more embodiments, the third reactor 40 may have a volume (and flow rate) that is 5 to 40% of the volume (and flow rate)

of the second reactor 30, and in certain embodiments, about 10 to 20% of the volume (and flow rate) of the second reactor 30.

The hydrocracking process configuration of the present disclosure, in which two reactors with two different functionalities are employed, is used to reduce or eliminate the HPNA streams in the hydrocracking process. The second reactor is employed for second stage hydrocracking while third reactor is employed for full hydrogenation service. The incorporation of the hydrogenating third reactor, operated at decreased pressure relative to the second reactor, into the two stage process enhances hydrocracking, eliminates HPNAs formed and, in turn, provides an economic benefit related to reduced equipment expenditure. The process and system of the present embodiments solves the problem without the implementation of other HPNA handling processes including recycling to vacuum tower, solvent deasphalting processing and adsorption.

EXAMPLES

Example 1

In Example 1, an apparatus having the configuration described and illustrated in FIG. 2 was provided. A feedstock blend containing 15% by volume of demetalized oil ("DMO") and 85% by volume of vacuum gas oil ("VGO") has the following distillation characteristics: 0W %=253° C.; 10W %=364° C.; 30W %=425° C.; 50W %=464° C.; 70W %=503° C.; 90W %=562° C.; 100W %, 606° C.

The operating conditions and catalysts for each reactor are summarized in Table 1. The $H_2S$, $NH_3$ and light gases were separated from the reactor effluent and the effluent fractionated into two fractions. The cut point between the fractions was varied at 20° C. intervals between 420° C. and 500° C. The lighter cut was sent to the second reactor 30 containing post modified zeolite based cracking catalysts for further cracking. The bottom fraction containing the higher boiling point HPNA molecules was sent to the third reactor 40 containing a noble metal containing hydrogenation catalysts composed of post modified USY and alumina as a binder with macro porosity, operating at a lower pressure than the second reactor 30 for hydrogenation and cracking.

HPNA molecules were hydrogenated in the third reactor 40 and the products were sent to fractionator column as recycle. The noble metal catalyst of the third reactor 40 requires less pressure and as a result, the third reactor may be smaller than the second reactor and specifically designed to operate at lower pressures. The third reactor 40 may 5 to 40% of the size of the second reactor in certain embodiments, and preferably 10 to 20% of the size of the second reactor in another embodiment. In this specific example, based upon the ratio of stream 22 and 23, the third reactor 40 is about 20% of the size of the second reactor 30.

TABLE 1

| Catalyst | | Reactor 1 1st Stage Hydrocracking Ni—Mo/Si—Al | Reactor 2 2nd Stage Hydrocracking Ni—Mo/Ti—Zr—USY/AL | Reactor 3 HPNA Hydrogenation Pt/Ti—Zr—USY/Al |
|---|---|---|---|---|
| Temperature | ° C. | 385 | 370 | 320 |
| Pressure | $Kg/cm^2$ | 120 | 120 | 60 |
| LHSV | $h^{-1}$ | 0.326 | 0.75 | 1 |
| H2/Oil Ratio | StLt/Lt | 1200 | 1200 | 1200 |

The material balance for the overall process is given in Table 2. As evidenced in the table, the HPNA were fully hydrogenated and resulted in a decreased bleed draw rate, a reduction from 3 V % to 0.1 V %.

TABLE 2

| Stream # | | 11 | 12 | 21 | 22 | 23 | 13 |
|---|---|---|---|---|---|---|---|
| Flow Rate | Kg/h | 100.00 | 102.81 | 81.20 | 17.79 | 3.32 | 103.15 |
| Hydrogen | Kg/h | 2.81 | 0.00 | 0.00 | 0.18 | 0.17 | 0.00 |
| H2S + NH3 | Kg/h | 0.00 | 2.58 | 2.58 | 0.00 | 0.00 | 2.58 |
| C1-C4 | Kg/h | 0.00 | 3.99 | 3.99 | 0.00 | 0.00 | 3.99 |
| Naphtha | Kg/h | 0.00 | 35.03 | 35.03 | 0.00 | 0.00 | 35.03 |
| Kerosene | Kg/h | 0.80 | 15.63 | 15.63 | 0.00 | 0.00 | 15.63 |
| Diesel | Kg/h | 10.10 | 24.46 | 23.99 | 0.47 | 0.00 | 45.70 |
| Unconverted Bottoms | Kg/h | 89.10 | 21.11 | 0.00 | 17.79 | 3.32 | 0.21 |
| Total Yield | Kg/h | 102.81 | 102.81 | 81.23 | 18.26 | 3.32 | 103.15 |

As shown in Table 2, the HPNA content of the unconverted bottoms in stream 23 is significantly reduced from 3.32 kg/h to 0.21 kg/h in stream 13 after undergoing hydrogenation at reduced pressures in the third reactor 40.

Figure 1:
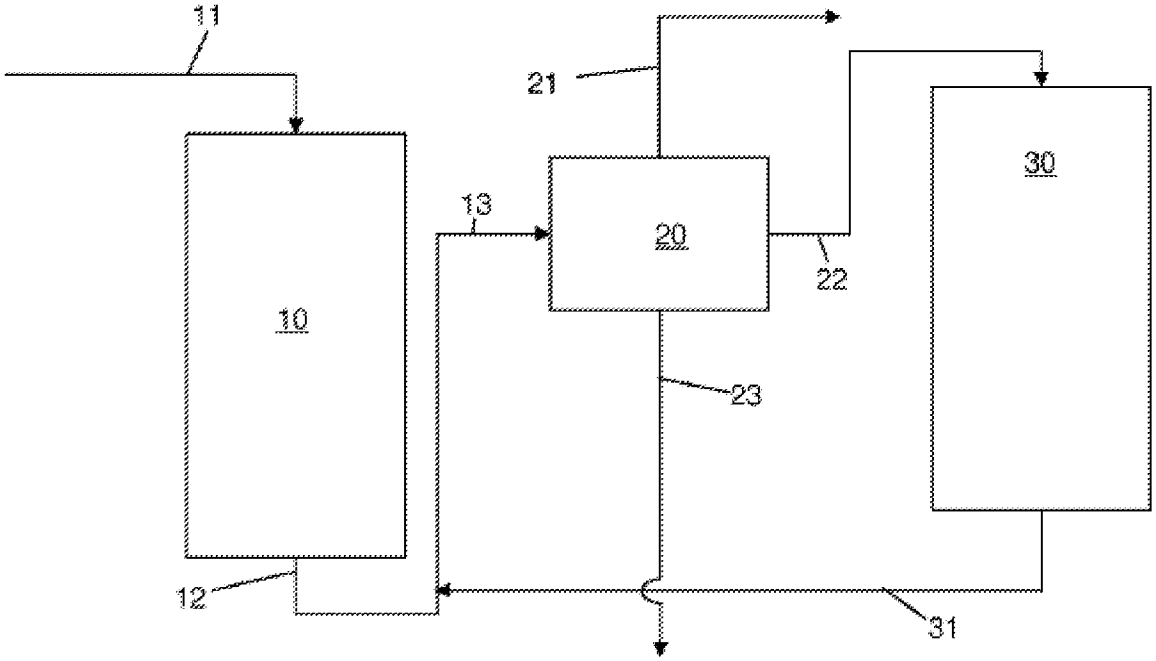
FIG. 1 PRIOR ART
FIG. 1 is a schematic diagram of a prior art two-stage hydrocracking apparatus and process.

In a Comparative Example 2, conducted in an apparatus having the configuration described and illustrated in FIG. 1. A feedstock blend containing 15% by volume of demetalized oil ("DMO") and 85% by volume of vacuum gas oil ("VGO") has the following distillation characteristics: 0W %=253° C.; 10W %=364° C.; 30W %=425° C.; 50W %=464° C.; 70W %=503° C.; 90W %=562° C.; 100W %, 606° C.

The operating conditions and catalysts for the first reactor 10 and second reactor 30 are comparable to those summarized in Table 1. The $H_2S$, $NH_3$ and light gases were separated from the reactor effluent and the effluent fractionated into two fractions. The cut point between the fractions was varied at 20° C. intervals between 420° C. and 500° C. The lighter cut was sent to the second reactor 30 containing post modified zeolite based cracking catalysts for further cracking. The bottom fraction containing the higher boiling point HPNA molecules was removed from the process via bleed stream 23 comprising HPNAs.

TABLE 3

| Stream # | | 11 | 12 | 21 | 22 | 23 |
|---|---|---|---|---|---|---|
| Flow Rate | Kg/h | 100.00 | 102.81 | 81.20 | 21.10 | 3.32 |
| Hydrogen | Kg/h | 2.81 | 0.00 | 0.00 | 0.18 | 0.00 |
| H2S + NH3 | Kg/h | 0.00 | 2.58 | 2.58 | 0.00 | 0.00 |
| C1-C4 | Kg/h | 0.00 | 3.99 | 3.99 | 0.00 | 0.00 |
| Naphtha | Kg/h | 0.00 | 35.03 | 35.03 | 0.00 | 0.00 |
| Kerosene | Kg/h | 0.80 | 15.63 | 15.63 | 0.00 | 0.00 |

TABLE 3-continued

| Stream # | | 11 | 12 | 21 | 22 | 23 |
|---|---|---|---|---|---|---|
| Diesel | Kg/h | 10.10 | 24.46 | 23.99 | 0.47 | 0.00 |
| Unconverted Bottoms | Kg/h | 89.10 | 21.11 | 0.00 | 21.10 | 3.32 |
| Total Yield | Kg/h | 102.81 | 102.81 | 81.23 | 21.75 | 3.32 |

As shown in Table 3, the bleed stream 23 comprising HPNA is removed from the process and 3.32 kg/h is not utilized. However, in Example 1, the third effluent stream 23 including 3.32 kg/h unconverted bottoms comprising HPNA is utilized, and the HPNA is hydrogenated and converted to a value added product.

Although the preceding description has been described herein with reference to particular means, materials and embodiments, it is not intended to be limited to the particulars disclosed herein; rather, it extends to all functionally equivalent structures, methods and uses, such as are within the scope of the appended claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A method of hydrocracking an oil feedstock to produce a light oil stream without build-up of heavy polynuclear aromatic (HPNA) hydrocarbons in a recycle stream, the method comprising the steps of:

hydrocracking the oil feedstock with a first stage hydrocracking catalyst possessing hydrotreating and hydrocracking functionality in a first reactor to produce an effluent stream;

fractionating the effluent stream into first, second and third product streams, wherein the first product stream comprises $C_1$-$C_4$, naphtha, and diesel boiling in the range of 36-370° C., the second product stream comprises hydrocarbon components having an initial nominal boiling point of 370° C. and a final boiling point ranging from 420-750° C., and the third product stream comprises HPNA hydrocarbons and other hydrocarbons boiling above 420° C. to 750° C., depending upon the final boiling point of the second product stream;

cracking the second product stream in a second reactor; and hydrogenating the third product stream in a third reactor over a noble metal hydrogenation catalyst at an operational pressure equal to or less than the second reactor.

2. The method of claim 1, wherein the feedstock oil comprises at least one of a vacuum gas oil, deasphalted or demetalized oil from a solvent deasphalting process, light and heavy coker gas oils from a coker process, cycle oils from a fluid catalytic cracking (FCC) process derived from crude oils, synthetic crude oils, heavy oils and/or bitumen, shale oil and coal oils.

3. The method of claim 1, wherein hydrocarbons after reactions in the second reactor and third reactor are sent to a separation unit.

4. The method of claim 1, wherein the hydrogenation catalyst of the third reactor is selected from the group consisting of zeolite based catalysts, amorphous alumina catalysts, amorphous silica-alumina catalysts, titania catalysts, and a combination comprising at least one of zeolite based catalysts, amorphous alumina catalysts and amorphous silica alumina catalysts, wherein the average pore diameter is at least 100 angstroms.

5. The method of claim 4, wherein the average pore diameter of the hydrogenation catalyst is at least 500 angstroms.

6. The method of claim 1, wherein the noble metal hydrogenation catalyst comprises one or more metals selected from the group consisting of Pt, Pd, Ru, or a mixture thereof.

7. The method of claim 1, wherein the third reactor comprises an unsupported metal catalyst.

8. The method of claim 7, wherein the unsupported catalyst is composed of at least one or more selected from the group of Ni, Mo, W, Co, Zn, Zr, or a mixture thereof.

9. The method of claim 1, wherein the first reactor further hydrodesulfurizes and hydrodenitrogenizes the oil feedstock, and the first product stream further includes $H_2S$ and $NH_3$.

10. The method of claim 1, wherein the first stage hydrocracking catalyst is selected from the group consisting of amorphous alumina catalysts, amorphous silica alumina catalysts, zeolite based catalyst, and a combination comprising at least one of amorphous alumina catalysts, amorphous silica alumina catalysts and zeolite based catalyst.

11. The method of claim 10, wherein the first stage hydrocracking catalyst further comprises an active phase of Ni, W, Mo, Co, or a combination comprising at least one of Ni, W, Mo and Co.

12. The method of claim 10, wherein 10% to 80% by volume of hydrocarbons boiling above 370° C. at a hydrogen partial pressure in the range of 100-200 kg/cm$^2$ are converted to one or more light gases selected from the group consisting of methane, ethane, propane, n-butane, isobutene, hydrogen sulfide, ammonia, naphtha fractions boiling in the range of 36° C. to 180° C., diesel fractions boiling in the range of 180° C. to 375° C., and combinations comprising at least one of the foregoing light gases.

13. The method of claim 12, wherein the hydrogen partial pressure is 100-150 kg/cm$^2$.

14. The method of claim 12, wherein the flow of feedstock oil is in the range of 300-2000 m$^3$ over 1000 m$^3$ of hydrotreating catalyst per hour.

15. The method of claim 1, wherein the operational pressure of the third reactor is 50-90 kg/cm$^2$.

* * * * *